US012790058B2

(12) United States Patent
Lee

(10) Patent No.: US 12,790,058 B2
(45) Date of Patent: Nov. 10, 2026

(54) SYSTEMS AND METHODS FOR VACUUM-PACKING, SHIPPING, AND ASSEMBLING FURNITURE ARTICLES

(71) Applicant: Rove Lab Inc., Vancouver (CA)

(72) Inventor: Art Lee, Vancouver (CA)

(73) Assignee: Rove Lab Inc., Vancouver (CA)

( * ) Notice: Subject to any disclaimer, the term of this patent is extended or adjusted under 35 U.S.C. 154(b) by 0 days.

(21) Appl. No.: 19/275,647

(22) Filed: Jul. 21, 2025

(65) Prior Publication Data

US 2026/0021922 A1 Jan. 22, 2026

Related U.S. Application Data

(60) Provisional application No. 63/673,870, filed on Jul. 22, 2024.

(51) Int. Cl.
*B65B 63/02* (2006.01)
*B65B 11/06* (2006.01)

(52) U.S. Cl.
CPC ..... *B65B 63/02* (2013.01); *B65B 11/06* (2013.01)

(58) Field of Classification Search
None
See application file for complete search history.

(56) References Cited

U.S. PATENT DOCUMENTS 3,641,726 A * 2/1972 Cassina ..... B65B 63/028 53/526
4,711,067 A * 12/1987 Magni ..... B65B 63/02 53/430
6,952,906 B2 10/2005 Nelson
2003/0066268 A1 4/2003 George
2008/0296182 A1* 12/2008 DiLiberto ..... B65D 85/07 206/223

(Continued)

FOREIGN PATENT DOCUMENTS

DE 202009000637 U1 4/2009
FR 2741247 A1 * 5/1997 ..... A47C 13/005

OTHER PUBLICATIONS

Internal Searching Authority, "International Search Report and Written Opinion," for PCT Application No. PCT/CA2025/050994, Oct. 16, 2025.

*Primary Examiner* — Tanzim Imam
(74) *Attorney, Agent, or Firm* — Dentons Durham Jones Pinegar

(57) ABSTRACT

This disclosure relates generally to systems and methods for packing furniture elements for shipping. A method of packing a furniture article includes compressing a block of high-density rebound foam forming the furniture article with a hydraulic press from an initial volume to a reduced volume. The reduced volume may be about one-fourth to about one-seventh of the initial volume and the furniture article may be substantially planar in the reduced volume. The method may also include reducing a pressure of the block of high-density rebound foam simultaneously to compressing the block of high-density rebound foam to form a compressed and pressurized furniture article. Further, the method may include rolling the compressed and pressurized furniture article in a wrapping to form a rolled furniture article for packing and shipping, and packing the rolled furniture article in a container for shipping.

19 Claims, 16 Drawing Sheets

(56) References Cited

U.S. PATENT DOCUMENTS

| | | | | |
|---|---|---|---|---|
| 2009/0293431 | A1* | 12/2009 | Andria | B65B 31/06 53/436 |
| 2010/0062921 | A1* | 3/2010 | Veiseh | B65B 51/146 383/110 |
| 2018/0305049 | A1* | 10/2018 | Wetsch | B32B 3/02 |
| 2019/0329966 | A1* | 10/2019 | Vadlja | B65B 13/20 |

* cited by examiner

SYSTEMS AND METHODS FOR VACUUM-PACKING, SHIPPING, AND ASSEMBLING FURNITURE ARTICLES

PRIORITY CLAIM

This application claims the benefit of and priority to U.S. Provisional Application No. 63/673,870 filed on Jul. 22, 2024 and titled, "SYSTEMS AND METHODS FOR VACUUM-PACKING, SHIPPING, AND ASSEMBLING FURNITURE ARTICLES," the entire contents of which are herein incorporated by reference.

TECHNICAL FIELD

This disclosure relates generally to systems and methods for vacuum-packing furniture articles, such as chairs, sofas, ottomans, etc. or for vacuum-packing elements of furniture articles for ease in transport and shipment of said furniture articles.

SUMMARY

Disclosed are systems, devices, and/or methods of use thereof regarding vacuum-packing furniture articles, such as chairs, sofas, ottomans, etc., or vacuum-packing elements of furniture articles. In various aspects, a method includes compressing a unitary block of high-density rebound foam with a hydraulic press from an initial volume to a compressed volume. The unitary block of high-density rebound foam forms a furniture article and the furniture article may be substantially planar in the compressed volume. The method may also include reducing a pressure, simultaneous to compressing, of the block of high-density rebound foam to form a compressed furniture article. Additionally, the method may include rolling the compressed furniture article in a wrapping to form a rolled furniture article for packing and shipping. Further, the method may include packing the rolled furniture article in a container for shipping and allowing the rolled furniture article to decompress and return to the initial volume. Still further, the method may include joining the furniture article in the initial volume to a second furniture article in an initial volume to form a linked furniture element.

In various aspects, a method of packing a furniture article includes compressing a block of high-density rebound foam forming the furniture article with a hydraulic press from an initial volume to a reduced volume. The reduced volume may be about one-fourth (¼) to about one-seventh (⅐) of the initial volume and the furniture article may be substantially planar in the reduced volume. The method may also include reducing a pressure of the block of high-density rebound foam simultaneously to compressing the block of high-density rebound foam to form a compressed and pressurized furniture article. Further, the method may include rolling the compressed and pressurized furniture article in a wrapping to form a rolled furniture article for packing and shipping, and packing the rolled furniture article in a container for shipping.

In various aspects, a method includes forming a furniture article from a unitary block of high-density rebound foam and compressing the furniture article with a hydraulic press from an initial volume to a compressed volume, where the compressed volume may be substantially planar. The method may also include reducing a pressure, simultaneous to compressing, of the furniture article to form a compressed furniture article. Additionally, the method may include rolling the compressed furniture article in a wrapping to form a rolled furniture article for packing and shipping, and packing the rolled furniture article in a container for shipping. Further, the method may include allowing the rolled furniture article to decompress and rebound to a rebounded volume and joining the furniture article in the rebounded volume to a second furniture article in a second rebounded volume to form a linked furniture system.

In various aspects, a method of forming a furniture article includes forming a first furniture element from a unitary block of high-density rebound foam and compressing the first furniture element with a hydraulic press from an initial volume to a compressed volume, with the compressed volume being substantially planar. The method may also include reducing a pressure, simultaneous to compressing, of the first furniture element to form a first compressed furniture element, rolling the first compressed furniture element in a wrapping to form a first rolled furniture element for packing and shipping, and allowing the rolled first furniture element to decompress and rebound to a rebounded volume. Further, the method may include forming a second furniture element from a unitary block of high-density rebound foam and compressing the second furniture element with a hydraulic press from an initial volume to a compressed volume, with the compressed volume being substantially planar. The method may also include reducing a pressure, simultaneous to compressing, of the second furniture element to form a second compressed furniture element and rolling the second compressed furniture element in a wrapping to form a second rolled furniture element for packing and shipping. Additionally, the method may include allowing the second rolled furniture element to decompress and rebound to a second rebounded volume and joining the first furniture element in the first rebounded volume to the second furniture element in the second rebounded volume to form the furniture article.

Other aspects of the disclosed subject matter, as well as features and advantages of various aspects of the disclosed subject matter, should be apparent to those of ordinary skill in the art through consideration of the ensuing description, the accompanying drawings, and the appended claims.

DETAILED DESCRIPTION

A variety of types of furniture have been developed over the years to provide comfort to consumers and decoration of living and other spaces. Consumers appreciate furniture which can withstand a high level of use without having to be quickly replaced. Thus, it is desirable to make furniture that is durable and high quality. Once purchased, consumers expect furniture to be easily assembled.

Some articles of furniture may comprise structures which include a component or components which are foam filled (e.g., polyurethane foam filled, etc.), as well as a component or components which are not foam filled, such as, for example, a futon comprising a polyurethane foam filled article and a frame. While conventional packaging processes for foam filled articles of furniture or components of furniture have become popular, the size of the packaged articles of furniture, among other things, remains largely problematic. In particular, using boxes, bags, or conventional packages to retain foam filled articles of furniture requires that the box, bag, or conventional package be of substantial size to adequately receive the foam filled articles of furniture. Consequently, conventional means of shipping, such as, for example, the United Parcel Service (UPS), Federal Express, or the United States Postal Service, may be expensive and/or unfeasible inasmuch as restrictions on the size of packages may drastically increase the price or even prohibit such large items from being shipped.

Another aspect that makes shipping and transport of furniture cost-prohibitive is the difficulty in stacking furniture. When large pieces of furniture are stacked, damage frequently occurs to the furniture located on the bottom of the stack. Even when furniture is disassembled and boxed in order to facilitate stacking, often there is still much wasted space which increases the cost of shipping. It would thus be an advantage to be able to have furniture which is easily stackable.

Another problem that occurs during shipping is that cushions or cushioned areas of furniture are often inadequately protected such that they are easily torn or punctured. For those consumers who cannot afford many pieces of furniture, it is also desirable to have furniture which can provide multiple functions. For example, a futon bed serves the function of both a bed and a couch. However, futon beds are bulky, and thus subject to the cost factors described above. In addition, futon mattresses are often thin and uncomfortable both as a couch and as a bed. Further, futon beds are difficult to transport to and from different locations. Thus, it would be an advantage to have a piece of furniture which can be conveniently packed and transported.

Figure 1:
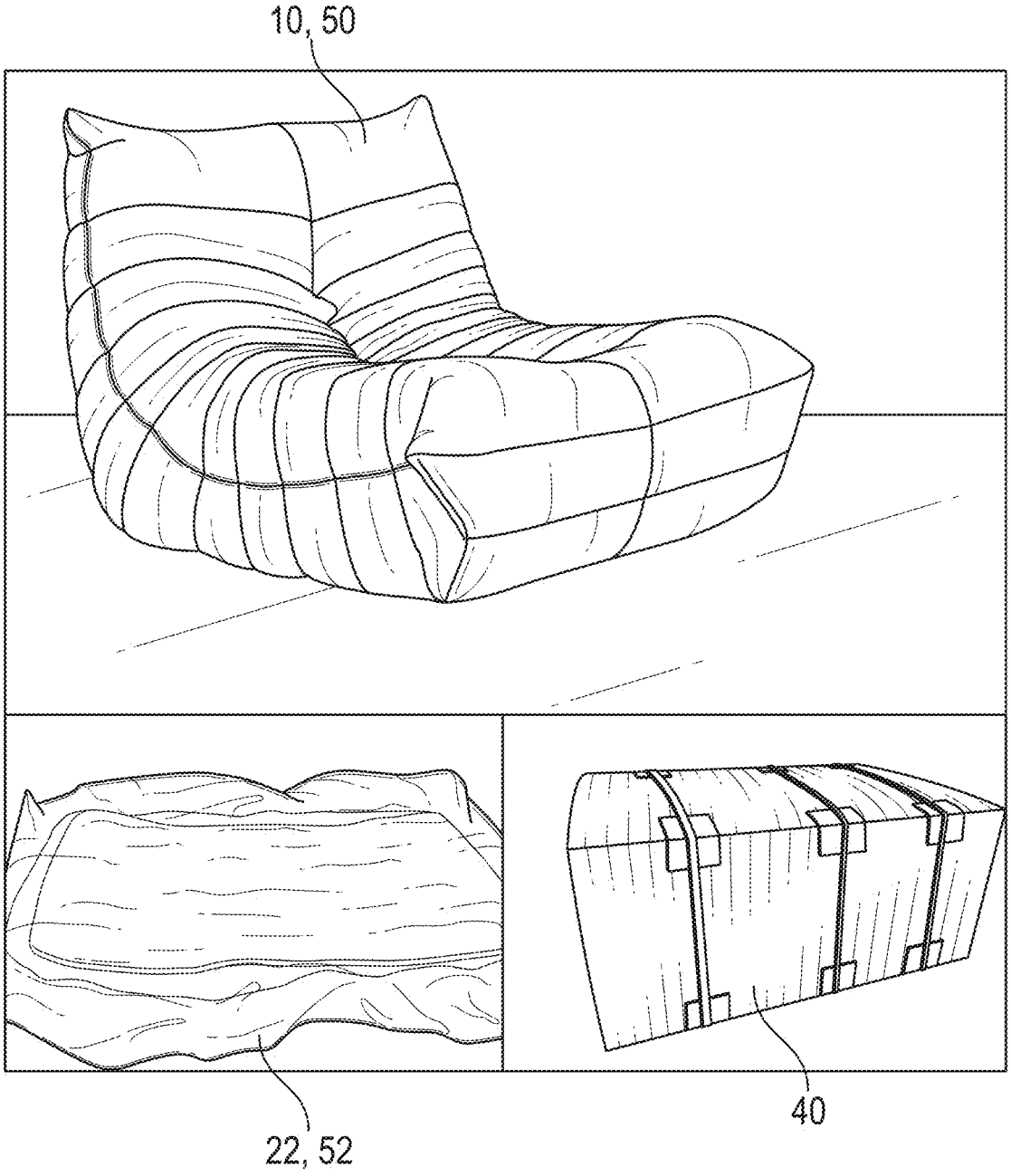
FIG. 1 schematically illustrates a furniture article and packing of the furniture article for shipping.

FIG. 1 schematically illustrates a furniture element 10 (or a furniture article 50) and packing of the furniture article 10 for shipping. A furniture element 10 may generally refer to a component of a furniture article 50 (e.g., a chair element 10 of a couch 50); however, it is to be understood that a furniture element 10 may itself be a furniture article 50, such as a chair 50. As discussed elsewhere, a furniture element 10 may be compressed and vacuum-packed for shipping. Specifically, the furniture element 10 may be compressed to a compressed furniture element 52 that may be contained within a wrapping 22 for shipping. The compressed furniture element 52 may be packed in a container 40 for transport and shipping.

Figure 2A:
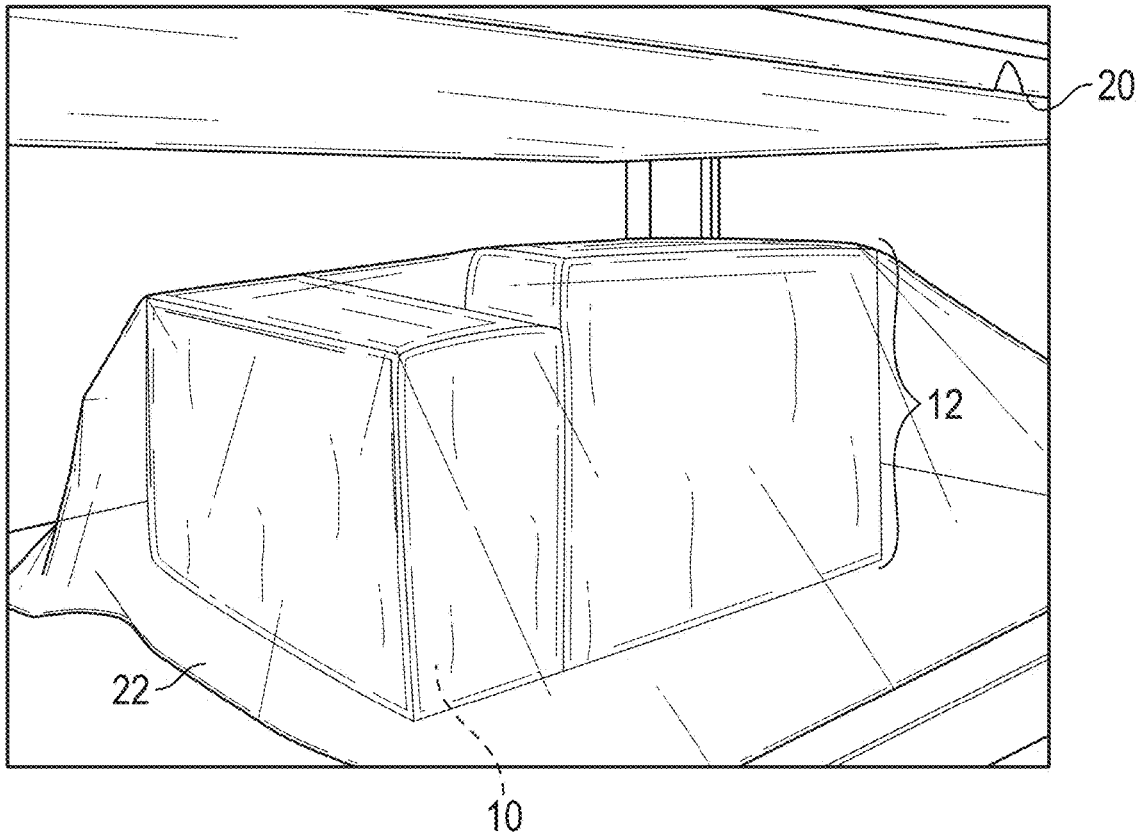
FIG. 2A illustrates a furniture element in an initial volume and FIG. 2B illustrates a compressing and vacuum-packing operation of the furniture element of FIG. 2A.
Figure 2B:
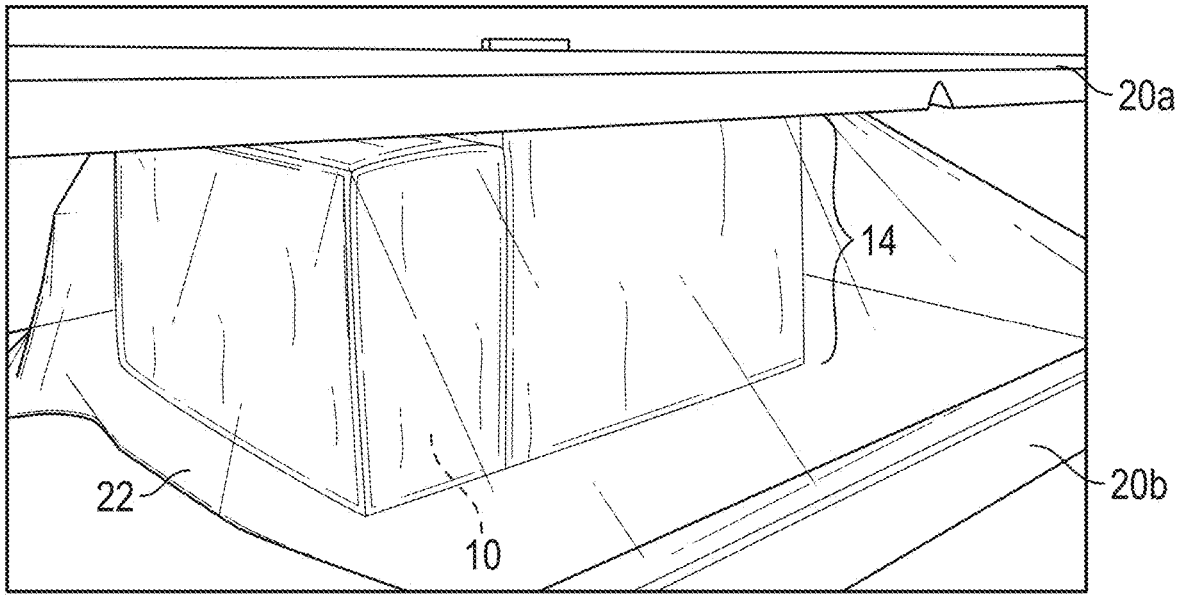
Figure 3A:
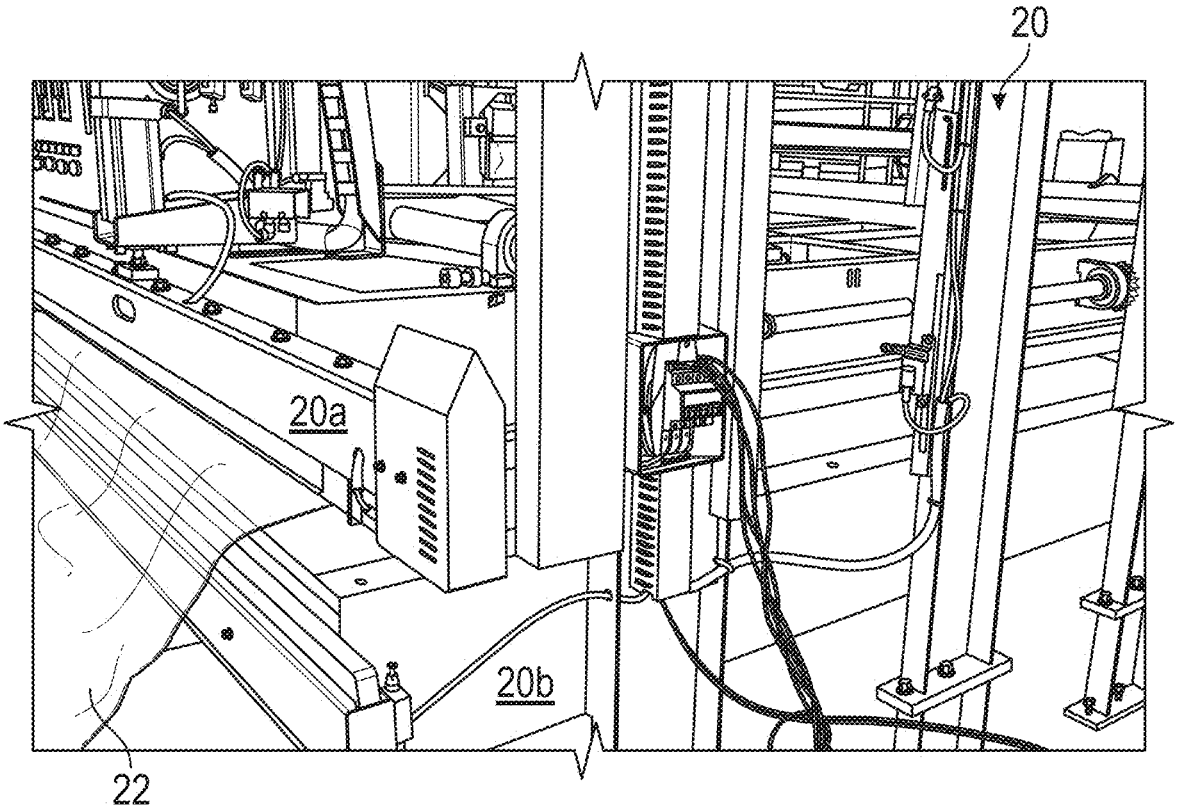
FIG. 3A illustrates the machine that executes the compressing and vacuum-packing operation for the furniture element of FIG. 2A
Figure 3B:
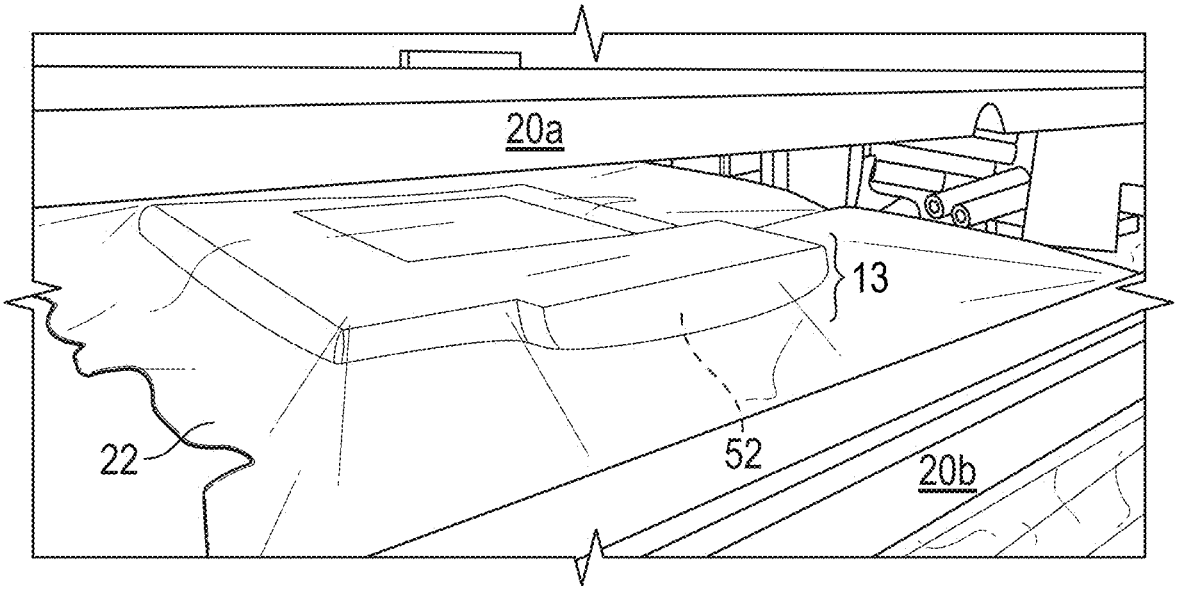
FIG. 3B illustrates the furniture element of FIG. 2A in a compressed volume.

FIGS. 2A through 3A illustrate a furniture element 10 undergoing a compressing and vacuum-packing operation and FIG. 3B illustrates a compressed furniture element 52 that is ready for packing, transport, and/or shipping, having undergone the compressing and vacuum-packing operation illustrated in FIGS. 2A through 3B. Specifically, as illustrated in FIG. 2A, the furniture element 10 is in an initial volume 12. The furniture element 10 may be a chair (as illustrated in FIG. 2A), an ottoman, a cushion, or another component of a furniture article (e.g., a couch or sofa, etc.) to be incorporated into the furniture article 50. Alternatively, the furniture element 10 may itself be a furniture article 50 (e.g., a chair). The furniture element 10 may be placed in or otherwise associated with a first wrapper 22. The furniture element 10 and the first wrapper 22 are placed in a press 20, such as a hydraulic press 20. The press 20 may include a top 20*a* and a bottom 20*b* (see FIG. 2B), and the furniture element 10 may be positioned between the top and bottom 20*a*, 20*b*, to be compressed.

As seen in FIGS. 2B to 3B, the press 20 (e.g., the top 20*a* and the bottom 20*b*) compresses the furniture element 10 from the initial volume 12 to a compressed volume 13 (see FIG. 3B). The furniture element 10 may pass through an intermediate volume 14 during the compression process. The compressed volume 13 may range from about one-fourth (¼) to about one-seventh (⅐) of the initial volume, such as about one-fifth (⅕) or one-sixth (⅙) of the initial volume. Simultaneous to the compression process, a pressure of the furniture element 10 may be reduced. That is, the furniture element 10 may be vacuum-packed within the first wrapper 22 simultaneously to being compressed by the press 20. The compression and simultaneous vacuum-packing produces a compressed furniture element 52 that is substantially planar. For example, a height of the compressed furniture element 52 may range from about fifteen (15) centimeters to about eighty (80) centimeters (cm), such as about 18, 20, 25, 30, 35, 40, 45, 50, 55, 60, 65, 70, 75 cm, or a height within a range defined by any two of the foregoing values.

Figure 4A:
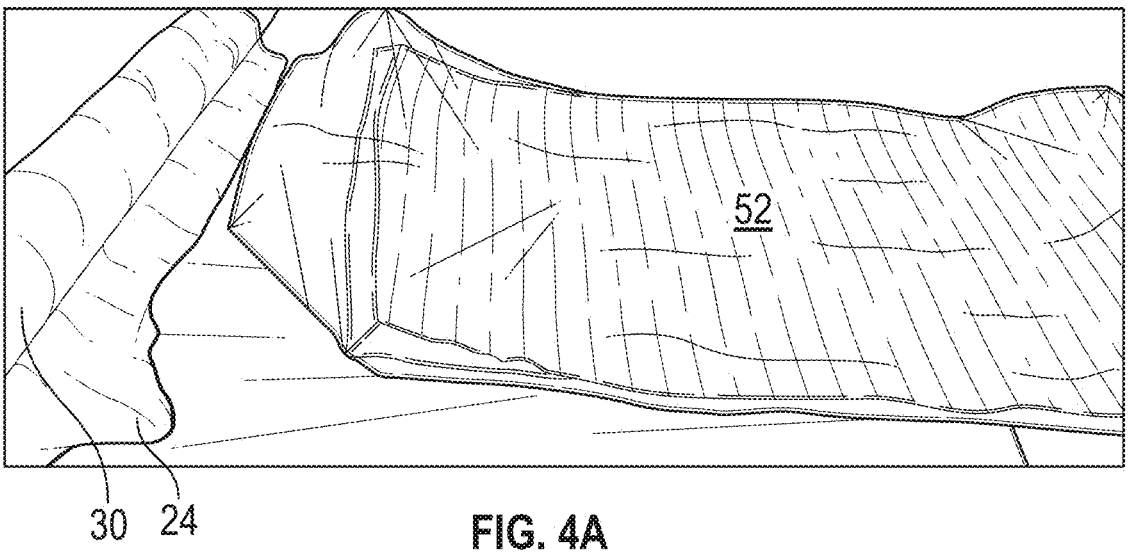
FIGS. 4A and 4B illustrate a rolling operation of the furniture element in the compressed volume.
Figure 4B:
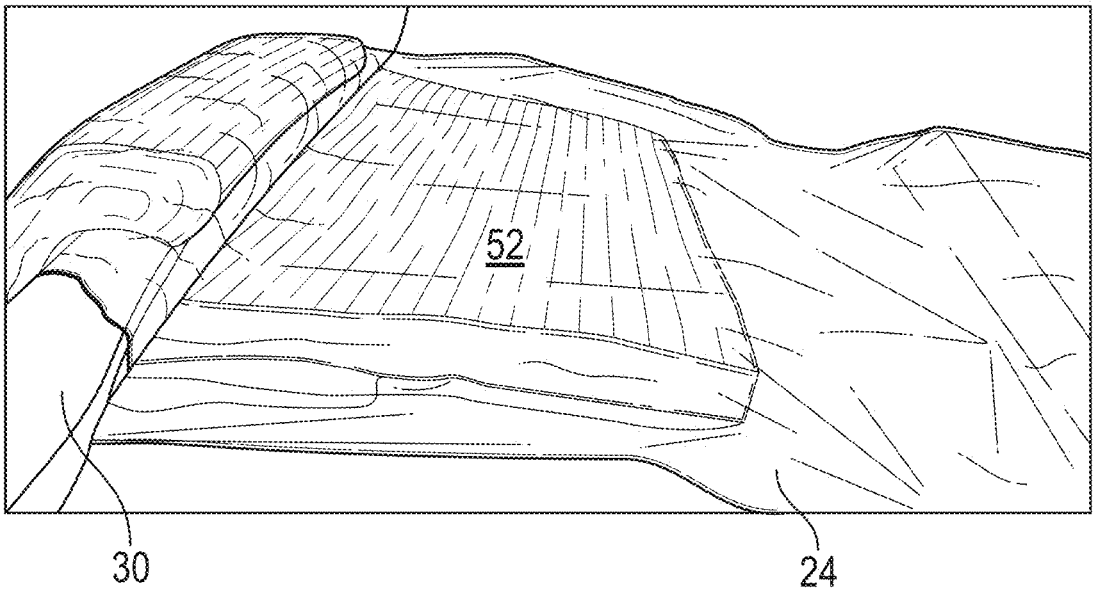
Figure 5:
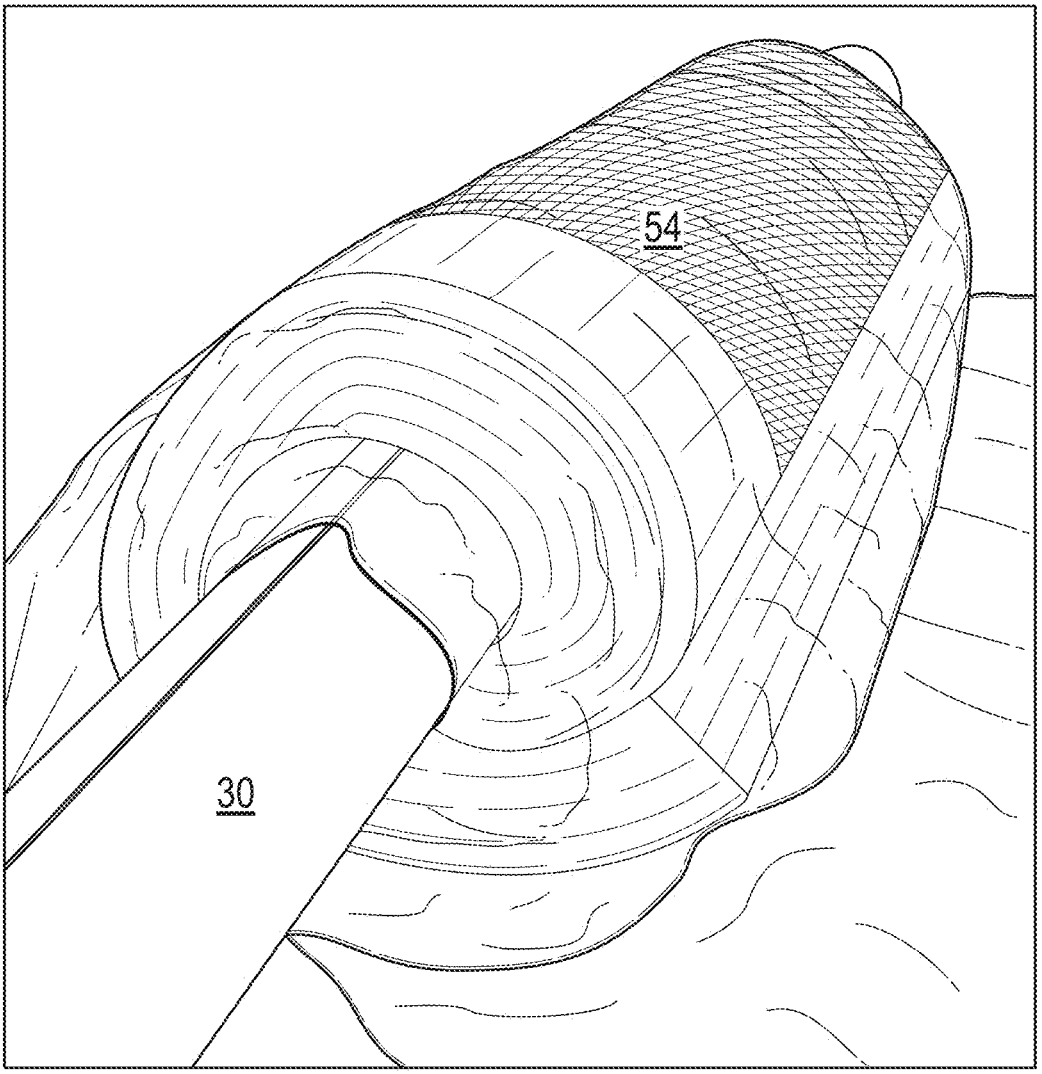
FIG. 5 illustrates a rolled furniture element that is ready for packing and shipping.

FIGS. 4A and 4B illustrate a rolling operation of the furniture element 10 (in the form of a compressed furniture element 52) in the compressed volume 14 and FIG. 5 illustrates a rolled furniture element 54 that is ready for packing and shipping. Specifically, after compressing, the compressed furniture element 52 is substantially planar, such that it can be rolled. The compressed furniture element 52 may be optionally placed within a second wrapping 24.

Figure 6:
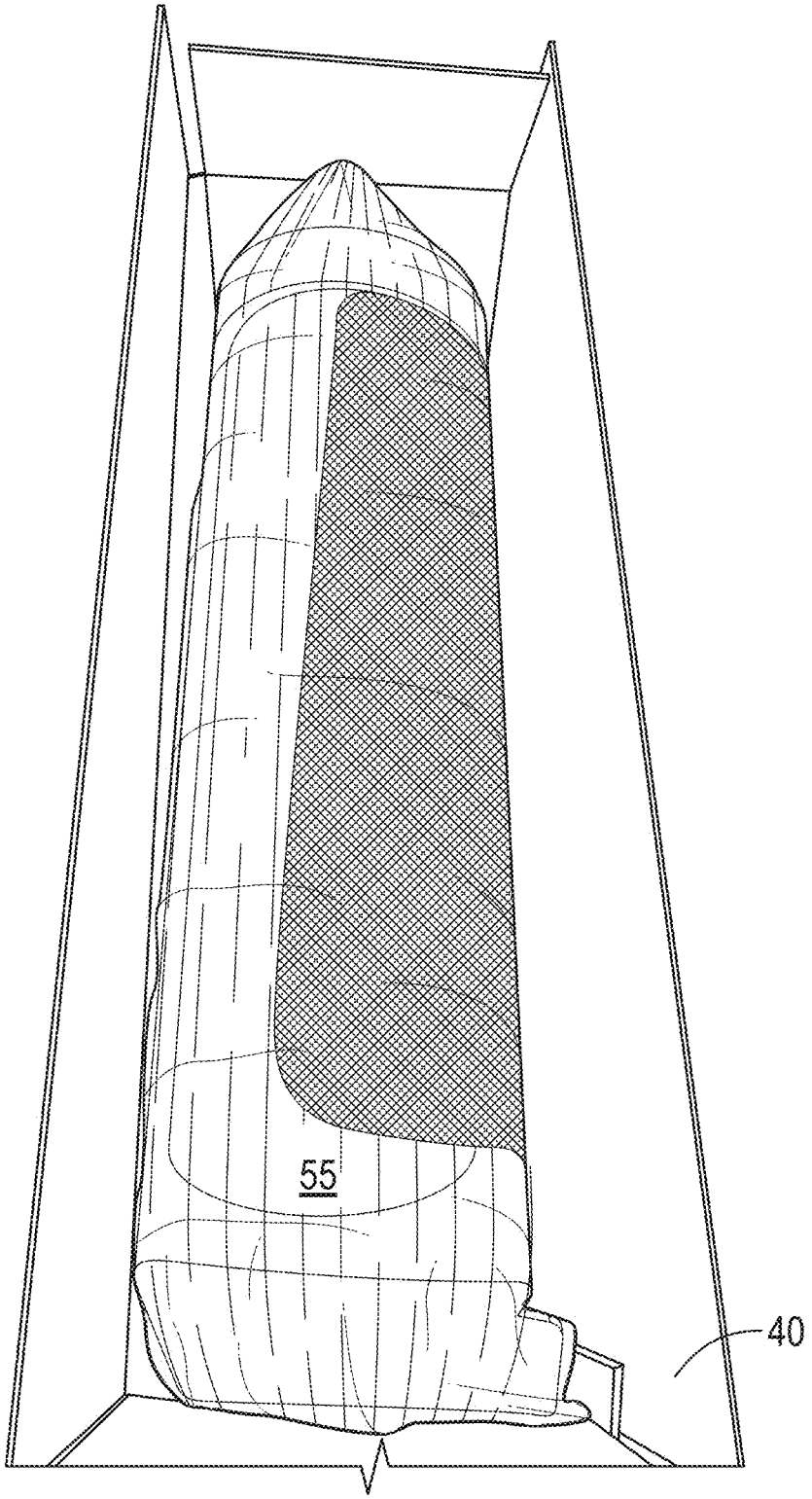
FIG. 6 illustrates the rolled furniture element of FIG. 5 packed in a container.

The compressed furniture element 52 may be rolled by a roller 30 to form a rolled furniture element 54. The rolled furniture element 54 may be associated with a container 40, such as a box or other appropriate container 40, to be transported and shipped. FIG. 6 illustrates the rolled furniture element 54 of FIG. 5 packed as a packed furniture element 55 in a container 40 for transport, storage, and/or shipping. Notably, the container 40 may be much smaller than would normally be required to pack and ship the furniture element 10 without a compression and vacuum-packing process.

In some embodiments, the container 40 may be of a size that falls into a "flat rate shipping" category (e.g., Flat Rate Shipping with UPS® or Priority Mail flat rate shipping with USPS®, etc.). This greatly reduces the costs associated with shipping a furniture element 10. Additionally, because the furniture element 10 has undergone the compression and vacuum-packing process, a weight of the furniture element 10 may be greatly reduced (e.g., due to the removal of air and, thus, weight from the furniture element 10), further reducing the costs associated with shipping.

Figure 7A:
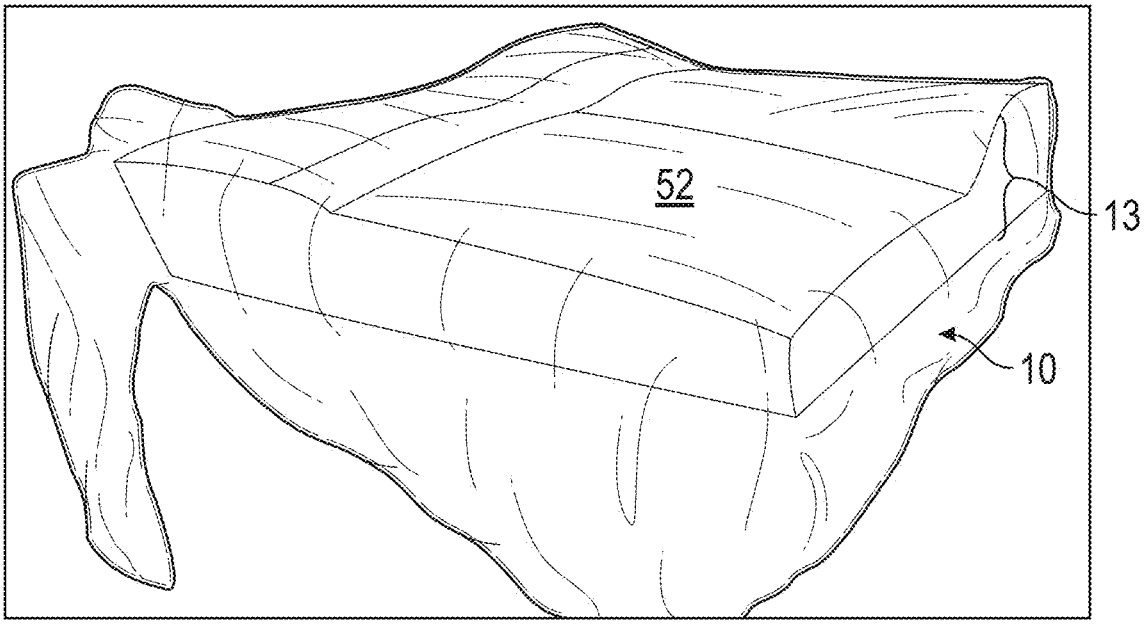
FIG. 7A illustrates an unrolled furniture element and FIG. 7B illustrates the unrolled furniture element of FIG. 7A beginning to decompress or rebound to the initial volume.
Figure 7B:
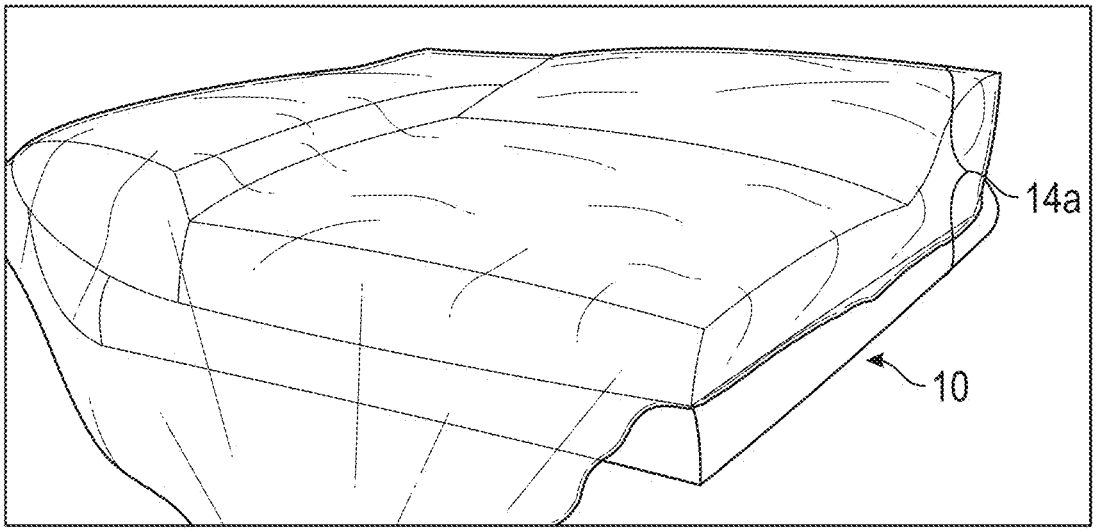
Figure 8A:
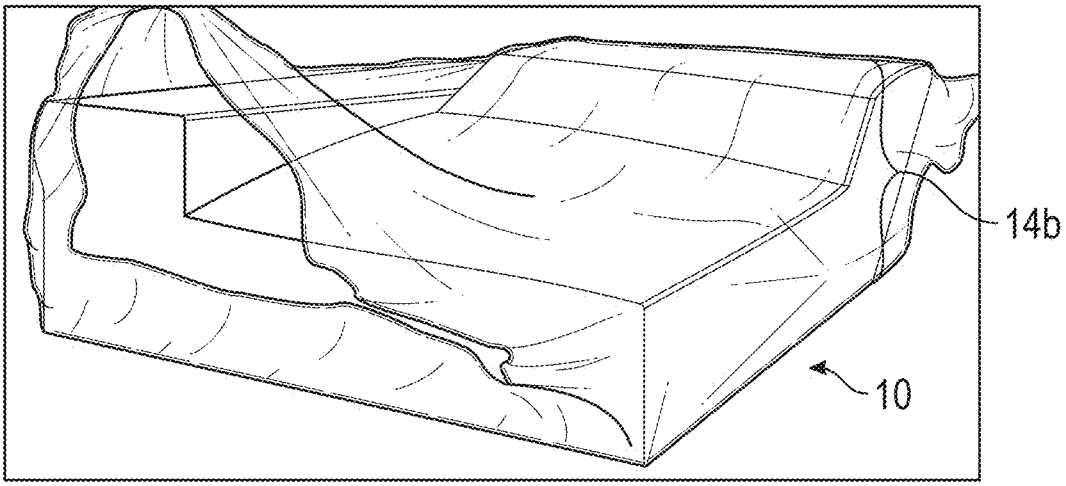
FIG. 8A illustrates additional rebounding of the unrolled furniture element of FIGS. 7A and 7B.
Figure 8B:
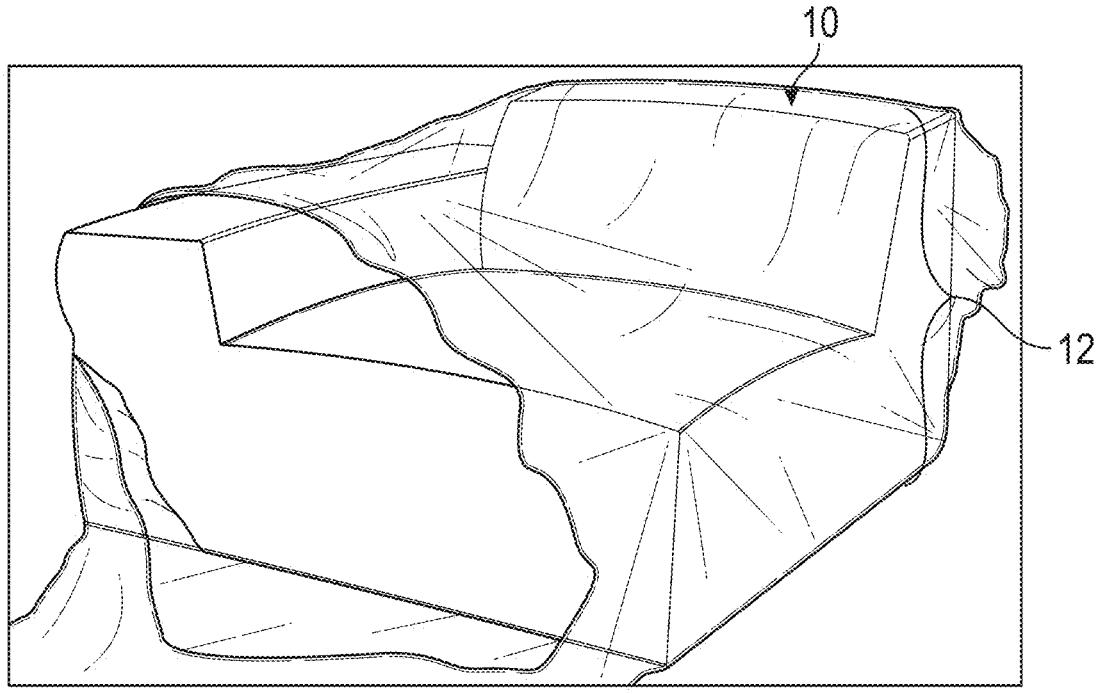
FIG. 8B illustrates the furniture element rebounded to the initial volume illustrated in FIG. 2A.

Once the packed furniture element 55 (which has been compressed and rolled) has reached a destination (e.g., a store, showroom, residence, etc.), it may be unpacked from the container 40, unrolled, and allowed to decompress. FIGS. 7A through 8B illustrate the furniture element 10 being unrolled and allowed to decompress or rebound to the initial volume 12. FIG. 7A illustrates the compressed furniture element 52 having been unpacked from the container and unrolled. When unpacked and unrolled, the compressed furniture element 52 is in the compressed volume 13. As the compressed furniture element 52 begins to decompress and rebound, the compressed furniture element 52 will pass through one or more intermediate volumes 14. For example, FIG. 7B illustrates a first intermediate volume 14*a* (the rebounding that occurs immediately or substantially immediately upon unpacking and unrolling the furniture element 10). FIG. 8A illustrates a second intermediate volume 14*b*, which is may be about 75% of the initial volume 12; the furniture element 10 has rebounded to the initial volume 12 in FIG. 8B.

Figure 9:
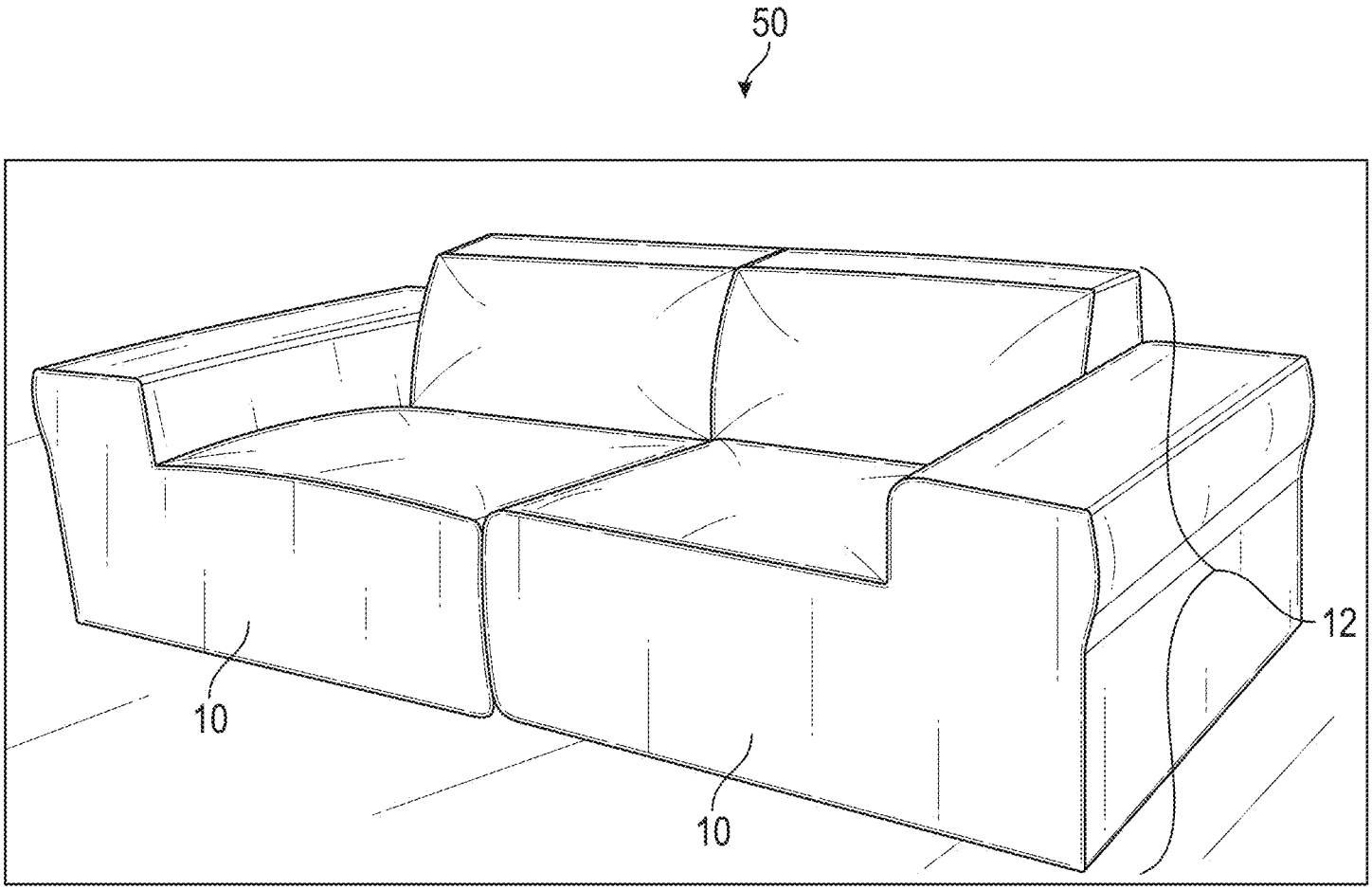
FIG. 9 illustrates one example of a furniture article formed from furniture elements, such as those illustrated in FIGS. 2A through 8B.

Once the furniture element 10 has rebounded to the initial volume 12, the furniture element 10 may be ready for use or may be incorporated into a larger furniture article or system 50. For example, FIG. 9 illustrates one example of a furniture article or furniture system 50 formed from furniture elements 10, such as those illustrated in FIGS. 2A through 8B. Specifically, FIG. 9 illustrates a couch or sofa 50 that is formed from two (2) furniture elements 10. Each furniture element 10 has rebounded to the initial volume 12 and has been joined to the adjacent furniture element 10. As discussed with respect to FIGS. 10A through 11B, each furniture element 10 may be covered in a decorative cover 16 that includes one or more connection mechanisms 17 for joining a first furniture element 10 to a second furniture element 10.

Figure 10A:
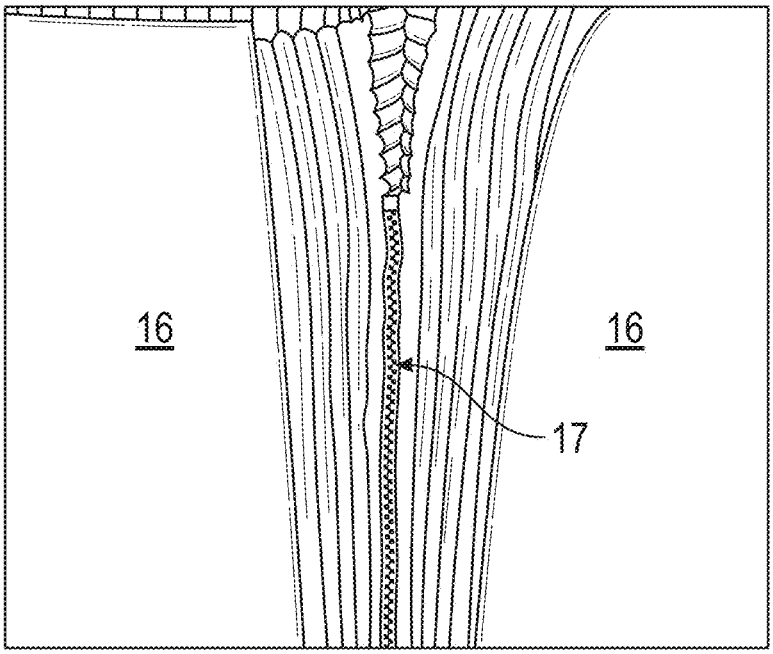
FIGS. 10A and 10B illustrate examples of connection mechanisms for joining two or more furniture elements together to form a furniture article, such as the furniture article illustrated in FIG. 9.
Figure 10B:
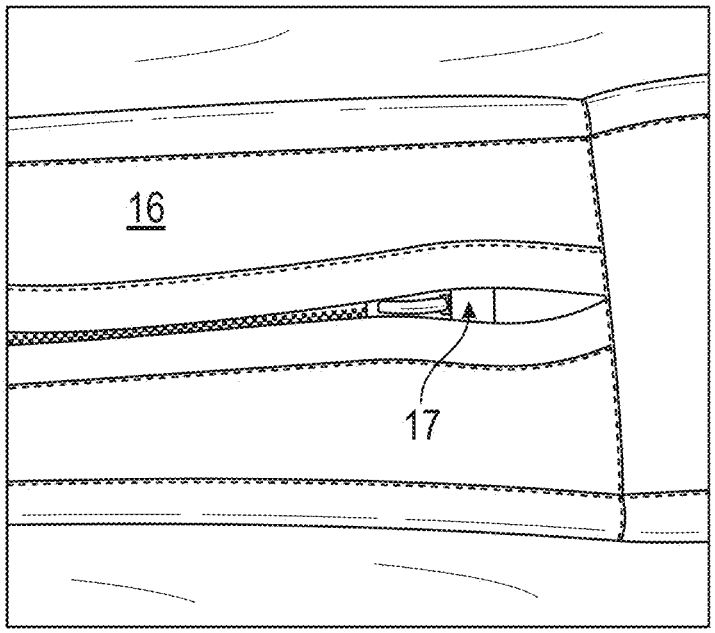

FIGS. 10A and 10B illustrate examples of connection mechanisms 17 for joining two or more furniture elements 10 together to form a furniture article 50, such as the furniture article illustrated in FIG. 9. The connection mechanism 17 may be a zipper, such as illustrated in FIGS. 10A and 10B, that may be incorporated (e.g., hidden) into a decorative cover 16. For example, the zipper 17 may be incorporated into a portion of the decorative cover 16 that is on the bottom of the furniture element 10, or otherwise hidden from view. Additionally, the zipper 17 may be incorporated into a pocket or channel of the decorative cover 16, such that the decorative cover 16 may hide the zipper 17 from view. The zipper 17 may facilitate joining of a first furniture element 10 to a second furniture element 10. Other connection mechanisms 17 that may be utilized include snaps, clips, toggles, hook-and-loop fasteners, male-female connection mechanisms, or another appropriate mechanism.

Figure 11A:
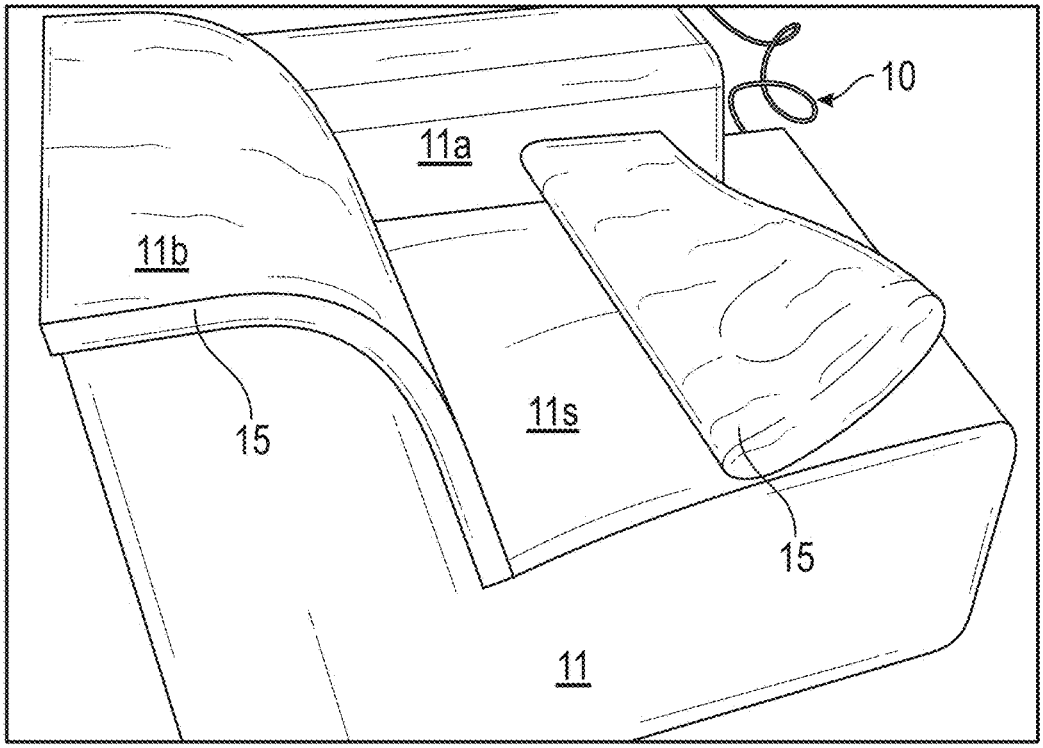
FIGS. 11A and 11B illustrate formation of the furniture element illustrated in FIG. 2A.
Figure 11B:
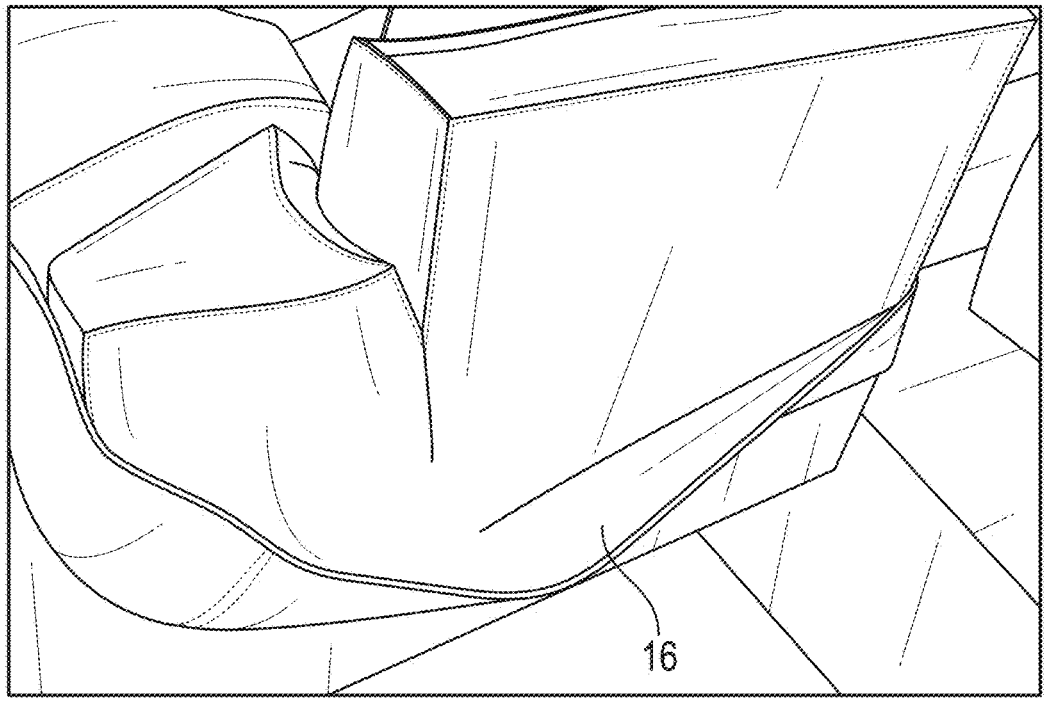

FIGS. 11A and 11B illustrate formation of the furniture element 10 illustrated in FIG. 2A. The furniture element 10 may be formed from a block of high-density rebound foam 11. For example, the furniture element 10 may be formed from a polyurethane foam, an open-cell polyurethane foam, polyethylene foam, an open-cell polyethylene foam, a polystyrene foam, an open-cell polystyrene foam, or another appropriate foam that is firm but flexible. In some embodiments, the furniture element 10 is formed from a unitary or singular block of high-density rebound foam rather than being formed from an aggregate of individual foam pieces or chunks. The furniture element 10 may be stamped, cut, or otherwise formed into an appropriate shape-cither to be incorporated into a furniture article 50 or to be a standalone furniture article, such as a chair. For example, the furniture element 10 may be formed as a chair having one arm on the left, a chair having one arm on the right, a chair having two arms (a left arm and a right arm), an ottoman, a portion of a sectional, a table, or any appropriate shape.

Batting 15 may be added on a portion of the block of high-density rebound foam 11 or may be added to the entire block of high-density rebound foam 11. For example, batting 15 may be added to a seating area 11*s*, a back portion 11*b*, and one or more arms 11*a*. Extra layers of batting 15 may be added where a user directly interfaces with the furniture element 10, such as at the seating area 11*s* and the back portion 11*b*. Alternatively, thick batting 15 may be added to those areas. A decorative cover 16 may encase the block of high-density rebound foam 11 and the batting 15.

Figure 12:
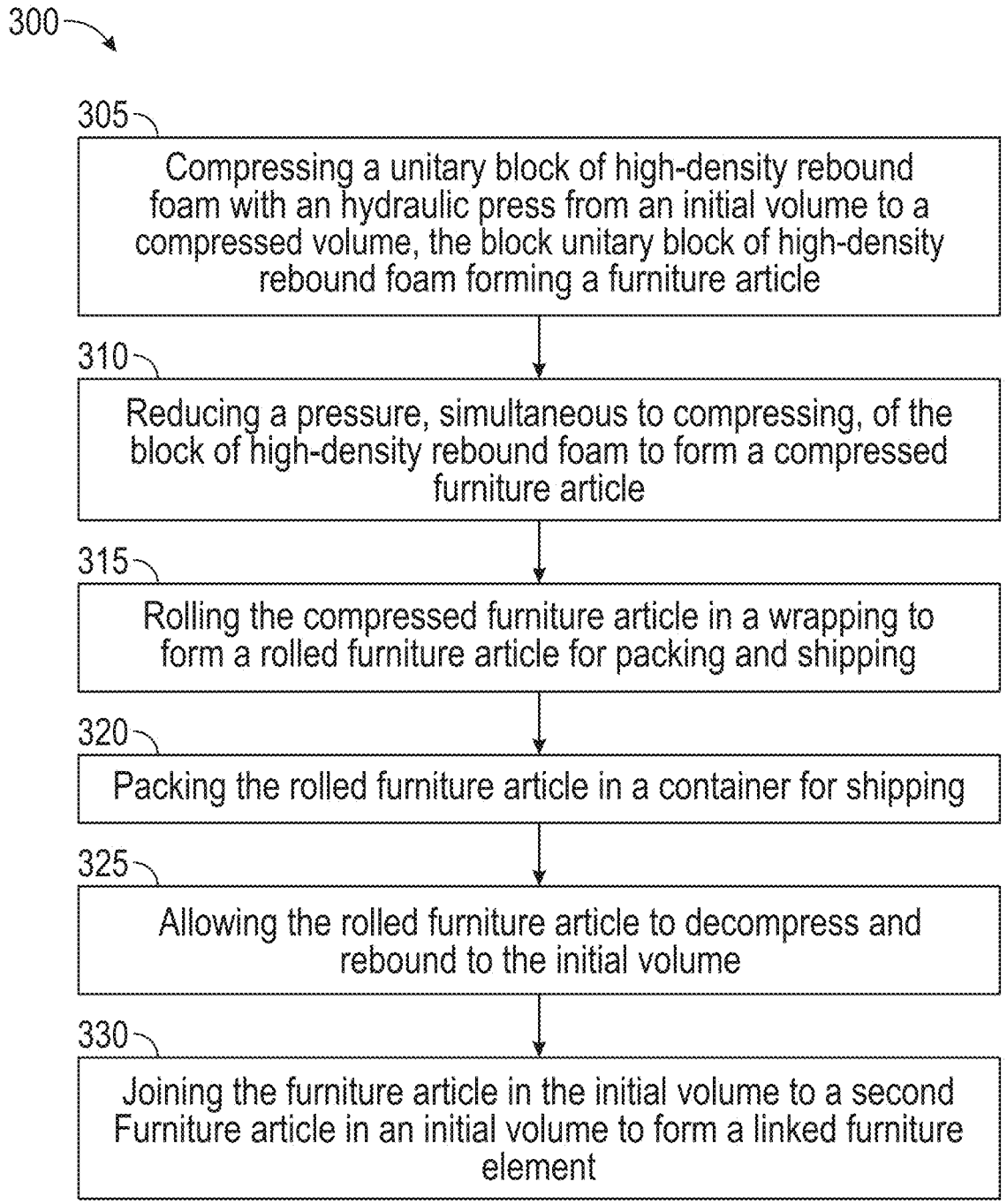
FIG. 12 is a flowchart of one example method of forming furniture elements and/or furniture articles, such as those illustrated in FIGS. 2A through 11B.

FIGS. 12 through 15 are flowcharts of example methods of forming furniture elements and/or furniture articles, such as those illustrated in FIGS. 2A through 10B. FIG. 12 illustrates one example method 300. In various aspects, the method 300 includes compressing a unitary block of high-density rebound foam with a hydraulic press from an initial volume to a compressed volume, at 305. The unitary block of high-density rebound foam forms a furniture article and the furniture article may be substantially planar in the compressed volume. The method 300 may also include reducing a pressure, simultaneous to compressing, of the block of high-density rebound foam to form a compressed furniture article, at 310. Additionally, the method 300 may include rolling the compressed furniture article in a wrapping to form a rolled furniture article for packing and shipping, at 315. Further, the method 300 may include packing the rolled furniture article in a container for shipping, at 320, and allowing the rolled furniture article to decompress and return to the initial volume, at 325. Still further, the method may include joining the furniture article in the initial volume to a second furniture article in an initial volume to form a linked furniture element, at 330.

Reducing a pressure, simultaneous to compressing, of the block of high-density rebound foam to form a compressed furniture article may include applying negative pressure to the block of high-density rebound foam and vacuum-packing the block of high-density rebound foam. Rolling the compressed furniture article in a wrapping to form a rolled furniture article for packing and shipping may include rolling the compressed furniture article in plastic wrap and binding the rolled furniture article with multiple strips of tape.

Figure 13:
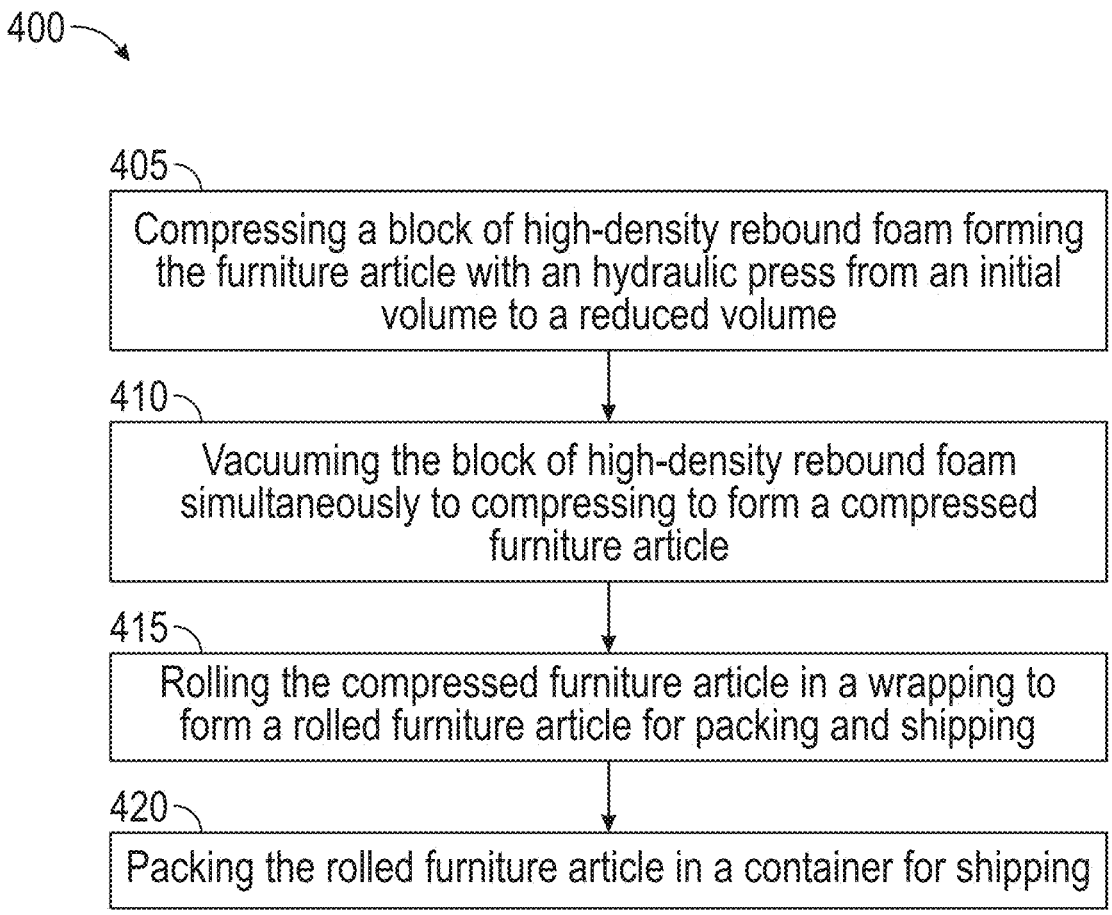
FIG. 13 is a flowchart of another example method of forming furniture elements and/or furniture articles, such as those illustrated in FIGS. 2A through 11B.

FIG. 13 illustrates a method 400 of packing a furniture article. The method 400 may include compressing a block of high-density rebound foam forming the furniture article with a hydraulic press from an initial volume to a reduced volume, at 405. The reduced volume may be about one-fourth to about one-seventh of the initial volume and the furniture article may be substantially planar in the reduced volume. The method 400 may also include vacuuming the block of high-density rebound foam simultaneously to compressing the block of high-density rebound foam to form a compressed furniture article, at 410. Further, the method may include rolling the compressed furniture article in a wrapping to form a rolled furniture article for packing and shipping, at 415, and packing the rolled furniture article in a container for shipping, at 420.

Figure 14:
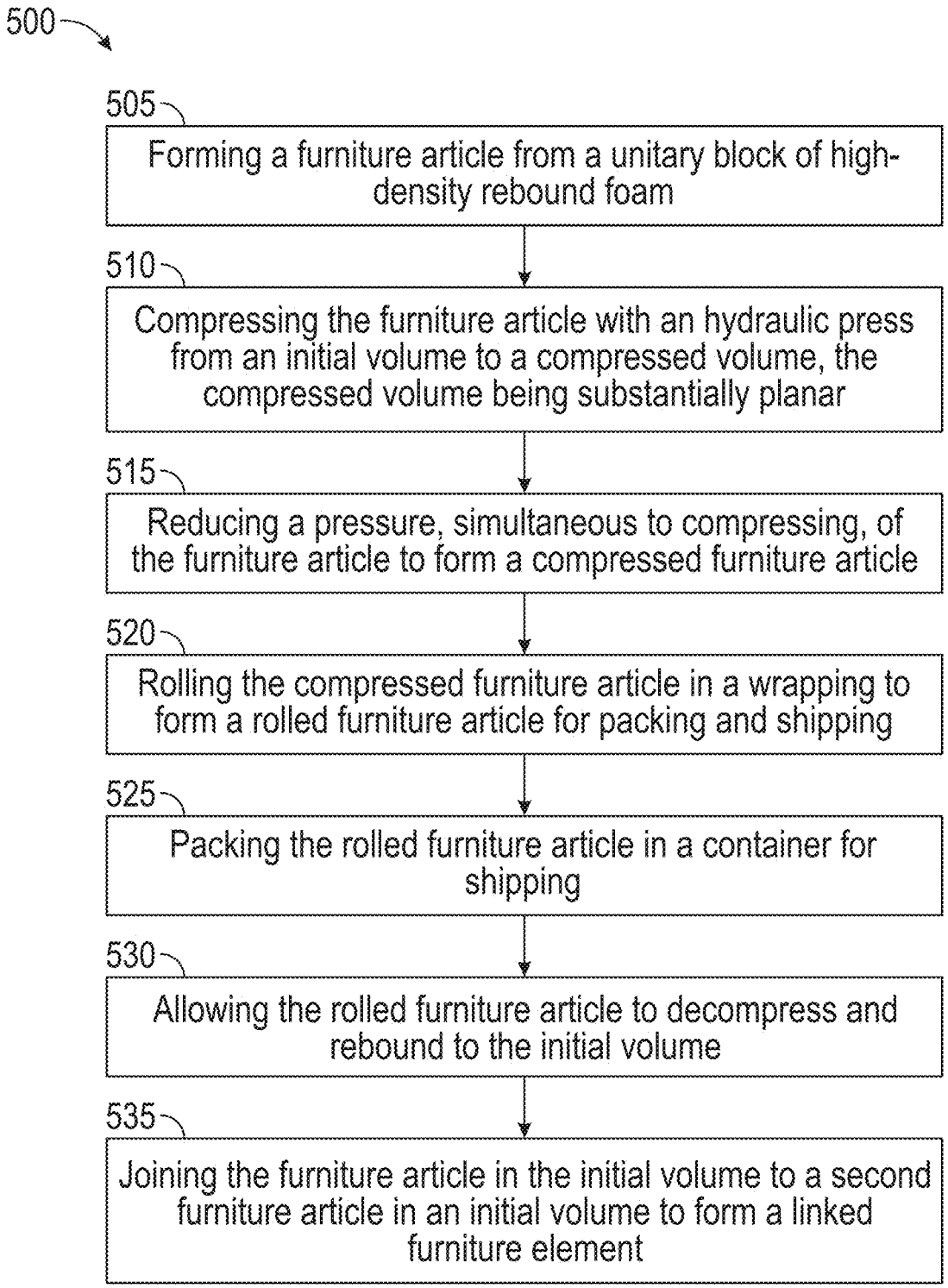
FIG. 14 is a flowchart of yet another example method of forming furniture elements and/or furniture articles, such as those illustrated in FIGS. 2A through 11B.

FIG. 14 illustrates a method 500. The method 500 may include forming a furniture article from a unitary block of high-density rebound foam, at 505, and compressing the furniture article with a hydraulic press from an initial volume to a compressed volume, where the compressed volume may be substantially planar, at 510. The method 500 may also include reducing a pressure, simultaneous to compressing, of the furniture article to form a compressed furniture article, at 515. Additionally, the method 500 may include rolling the compressed furniture article in a wrapping to form a rolled furniture article for packing and shipping, at 520, and packing the rolled furniture article in a container for shipping, at 525. Further, the method 500 may include allowing the rolled furniture article to decompress and rebound to a rebounded volume, at 530, and joining the furniture article in the rebounded volume to a second furniture article in a second rebounded volume to form a linked furniture system, at 535.

The linked furniture system may be a couch or sofa, such as the furniture article illustrated in FIG. 9. The method 500 may further include joining a third furniture article in a third rebounded volume to the linked furniture system.

Figure 15:
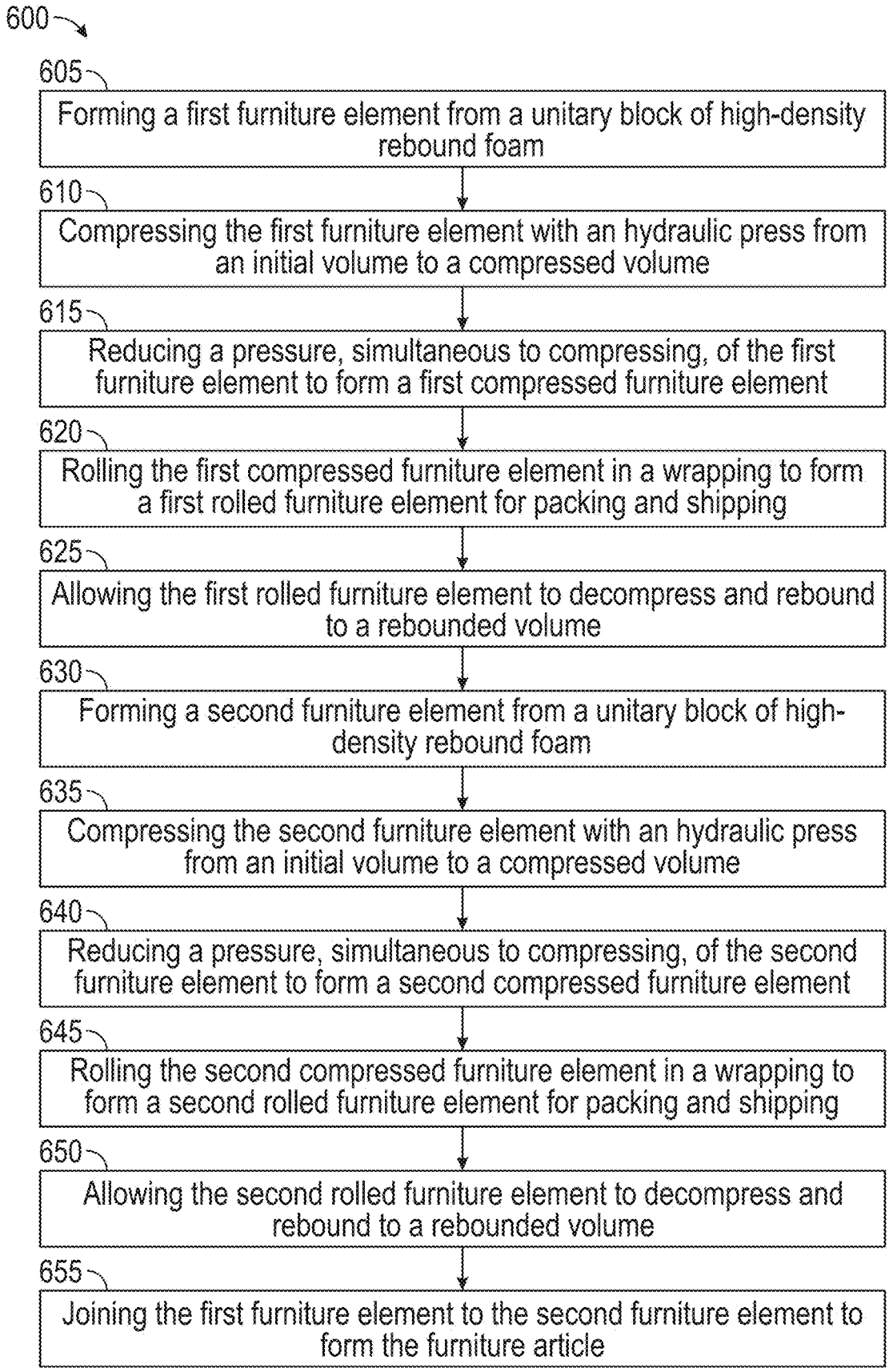
FIG. 15 is a flowchart of yet another example method of forming furniture elements and/or furniture articles, such as those illustrated in FIGS. 2A through 11B.

FIG. 15 is a flowchart for an example method 600 of forming a furniture article. The method 600 may include forming a first furniture element from a unitary block of high-density rebound foam, at 605, and compressing the first furniture element with a hydraulic press from an initial volume to a compressed volume, with the compressed volume being substantially planar, at 610. The method 600 may also include reducing a pressure, simultaneous to compressing, of the first furniture element to form a first compressed furniture element, at 615, rolling the first compressed furniture element in a wrapping to form a first rolled furniture element for packing and shipping, at 620, and allowing the rolled first furniture element to decompress and rebound to a rebounded volume, at 625.

Further, the method 600 may include forming a second furniture element from a unitary block of high-density rebound foam, at 630, and compressing the second furniture element with a hydraulic press from an initial volume to a compressed volume, with the compressed volume being substantially planar, at 635. The method 600 may also include reducing a pressure, simultaneous to compressing, of the second furniture element to form a second compressed furniture element, at 640, and rolling the second compressed furniture element in a wrapping to form a second rolled furniture element for packing and shipping, at 645. Additionally, the method 600 may include allowing the second rolled furniture element to decompress and rebound to a second rebounded volume, at 650, and joining the first furniture element in the first rebounded volume to the second furniture element in the second rebounded volume to form the furniture article, at 655.

The method 600 may additionally include forming a third furniture element from a unitary block of high-density rebound foam and compressing the third furniture element with a hydraulic press from an initial volume to a compressed volume, with the compressed volume being substantially planar. The method 600 may also include reducing a pressure, simultaneous to compressing, of the third furniture element to form a third compressed furniture element and rolling the third compressed furniture element in a wrapping to form a third rolled furniture element for packing and shipping. Additionally, the method 600 may include allowing the third rolled furniture element to decompress and rebound to a third rebounded volume. The third furniture element may be associated with (e.g., joined to, in the vicinity of, etc.) the furniture article. For example, the third furniture element may be an ottoman that is in association with a couch, sofa, or sectional.

In some embodiments, a method of forming a furniture article may form a couch. In such embodiments, the method may include forming a first couch element from a unitary block of high-density rebound foam and compressing the first couch element with a hydraulic press from an initial volume to a compressed volume, with the compressed volume being substantially planar. The first couch element may include a seat portion and a back portion. The method may also include reducing a pressure, simultaneous to compressing, of the first couch element to form a first compressed couch element, rolling the first compressed couch element in a wrapping to form a first rolled couch element for packing and shipping, and allowing the rolled first couch element to decompress and rebound to a rebounded volume.

Further, the method may include forming a second couch element from a unitary block of high-density rebound foam, and compressing the second couch element with a hydraulic press from an initial volume to a compressed volume, with the compressed volume being substantially planar. The second couch element may similarly include a seat portion and a back portion. The method may also include reducing a pressure, simultaneous to compressing, of the second couch element to form a second compressed couch element, and rolling the second compressed couch element in a wrapping to form a second rolled couch element for packing and shipping. Additionally, the method may include allowing the second rolled couch element to decompress and rebound to a second rebounded volume, and joining the first couch element in the first rebounded volume to the second couch element in the second rebounded volume to form the couch.

The method may additionally include forming a third couch element from a unitary block of high-density rebound foam and compressing the third couch element with a hydraulic press from an initial volume to a compressed volume, with the compressed volume being substantially planar. The method may also include reducing a pressure, simultaneous to compressing, of the third couch element to form a third compressed couch element and rolling the third compressed couch element in a wrapping to form a third rolled couch element for packing and shipping. Additionally, the method may include allowing the third rolled couch element to decompress and rebound to a third rebounded volume. The third couch element may be associated with (e.g., joined to, in the vicinity of, etc.) the couch. For example, the third couch element may be an ottoman that is in association with the couch. Alternatively, the third couch element may be a sectional portion that can be associated with the couch to convert the couch into a sectional.

Figure 16:
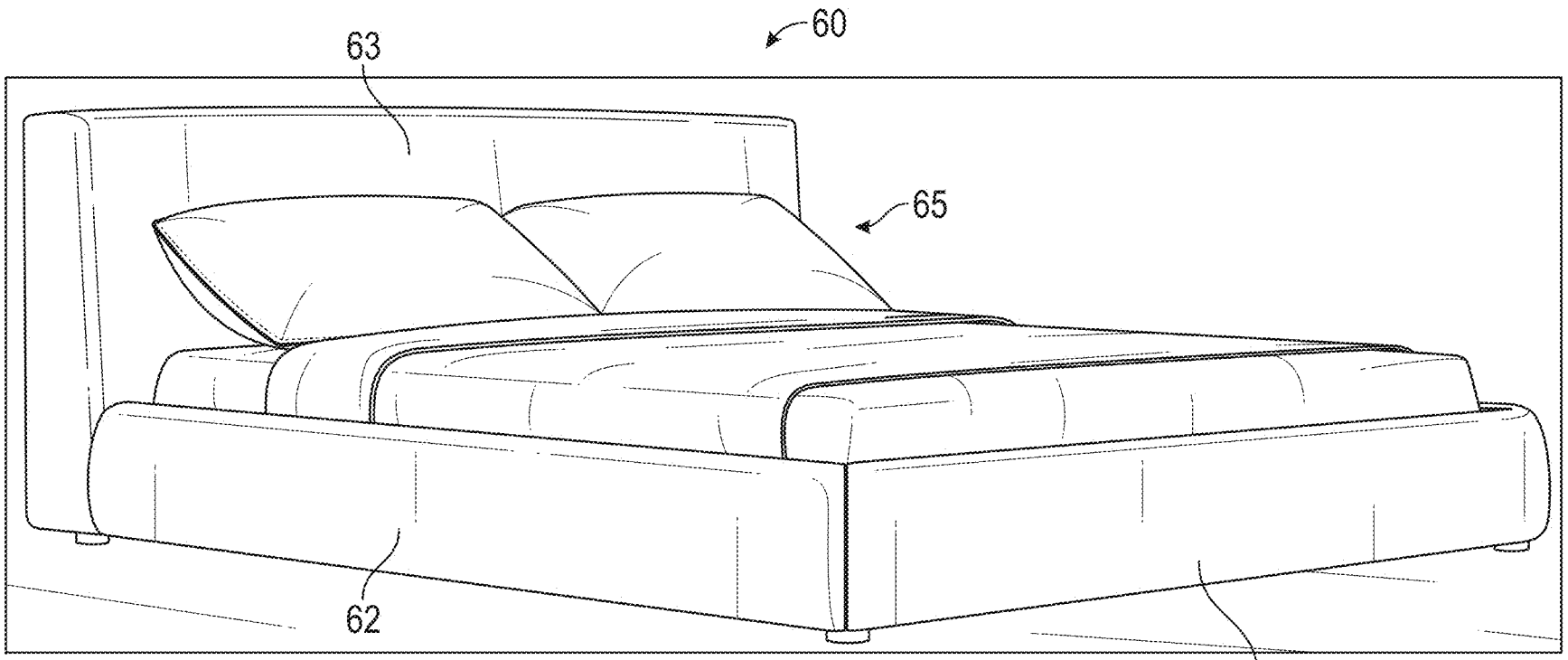
FIG. 16 illustrates another example of a furniture article formed from a plurality of furniture elements.

FIG. 16 illustrates another example of a furniture article 60 formed from a plurality of furniture elements 62, 63. Specifically, the furniture article 60 is a bed (e.g., a twin, full, queen, king size etc.) that includes one or more panels 62 and a headboard 63. Each of the panels 62 and the headboard 63 may undergo a formation and compression process, as described.

For example, the panels 62 and/or the headboard 63 may be formed from blocks of high-density rebound foam or another appropriate material. The panels 62 and/or the headboard 63 may be covered in a decorative cover (see for example, the decorative cover 16 of FIGS. 10A to 11B). Similar to the decorative covers 16, the decorative covers for the panels 62 and/or the headboard 63 may include features or mechanisms allowing the panels 62 and/or the headboard 63 to be joined to each other in forming the furniture article 60. Referring briefly to FIGS. 10A to 11B, the decorative covers 16 may incorporate zippers, slides, snaps, or other appropriate mechanisms for joining each panel 62 to an adjacent panel 62 and to the headboard 63.

The panels 62 and/or the headboard 63 may be compressed with a hydraulic press and vacuum-packed to form substantially planar furniture elements, similar to the compressed furniture element 52 illustrated in FIG. 3B. Specifically, the panels 62 and/or the headboard 63 may be compressed from an initial volume to a compressed volume, where the compressed volume is substantially planar. Subsequently, the panels 62 and/or the headboard 63 may be rolled, packed, and shipped.

After shipping and unpacking, the panels 62 and/or the headboard 63 may be allowed to decompress and rebound to their initial volume (e.g., initial volume 12). Once in their initial volume, the panels 62 and/or the headboard 63 may be joined together to form the furniture article 60. As stated, the decorative covers may facilitate joining of the panels 62 and/or the headboard 63. This mechanism may allow for quick assembly of the furniture article 60 once the panels 62 and headboard 63 have been decompressed and rebounded to an initial volume. In some embodiments, the furniture article 60 may include furniture accessories 65, such as pillows, blankets, mattresses, cushions, etc. The furniture accessories 65 may also, though not necessarily, have undergone a compression and shipping process.

EMBODIMENTS

Embodiment 1. A method comprising: compressing a unitary block of high-density rebound foam with a hydraulic press from an initial volume to a compressed volume, the unitary block of high-density rebound foam forming a furniture article, the furniture article being substantially planar in the compressed volume; reducing a pressure, simultaneous to compressing, of the unitary block of high-density rebound foam to form a compressed furniture article; rolling the compressed furniture article in a wrapping to form a rolled furniture article for packing and shipping; packing the rolled furniture article in a container for shipping; allowing the rolled furniture article to decompress and return to the initial volume; and joining the furniture article in the initial volume to a second furniture article in an initial volume to form a linked furniture element.

Embodiment 2. The method of Embodiment 1, wherein reducing a pressure, simultaneous to compressing, of the unitary block of high-density rebound foam to form a compressed furniture article comprises: applying negative pressure to the unitary block of high-density rebound foam; and vacuum-packing the unitary block of high-density rebound foam.

Embodiment 3. The method of Embodiment 1 or Embodiment 2, wherein the compressed volume is about one-fourth to about one-seventh of the initial volume.

Embodiment 4. The method of any one of Embodiments 1 through 3, wherein rolling the compressed furniture article in a wrapping to form a rolled furniture article for packing and shipping comprises: rolling the compressed furniture article in plastic wrap; and binding the rolled furniture article with multiple strips of tape.

Embodiment 5. The method of any one of Embodiments 1 through 4, wherein packing the rolled furniture article in a container for shipping comprises packing the rolled furniture article in a box.

Embodiment 6. The method of any one of Embodiments 1 through 5, wherein the unitary block of high-density rebound foam forms a chair.

Embodiment 7. The method of any one of Embodiments 1 through 6, wherein the unitary block of high-density rebound foam forms an ottoman.

Embodiment 8. The method of any one of Embodiments 1 through 7, wherein joining the furniture article in the initial volume to a second furniture article comprises zipping the furniture article to the second furniture article.

Embodiment 9. The method of any one of Embodiments 1 through 8, further comprising covering the unitary block of high-density rebound foam with a decorative outer cover. Embodiment 10. The method of Embodiment 9, wherein covering the unitary block of high-density rebound foam occurs before compressing the unitary block of high-density rebound foam.

Embodiment 11. The method of Embodiment 9 or 10, wherein joining the furniture article in the initial volume to a second furniture article comprises connecting a zipper of the decorative outer cover with a zipper of a decorative outer cover of the second furniture article.

Embodiment 12. A method of packing a furniture article, the method comprising: compressing a block of high-density rebound foam forming the furniture article with a hydraulic press from an initial volume to a reduced volume, the reduced volume being about one-fourth to about one-seventh of the initial volume, and the furniture article being substantially planar in the reduced volume; reducing a pressure of the block of high-density rebound foam simultaneously to compressing the block of high-density rebound foam to form a compressed and pressurized furniture article; rolling the compressed and pressurized furniture article in a wrapping to form a rolled furniture article for packing and shipping; and packing the rolled furniture article in a container for shipping.

Embodiment 13. A method comprising: forming a furniture article from a unitary block of high-density rebound foam; compressing the furniture article with a hydraulic press from an initial volume to a compressed volume, the compressed volume being substantially planar; reducing a pressure, simultaneous to compressing, of the furniture article to form a compressed furniture article; rolling the compressed furniture article in a wrapping to form a rolled furniture article for packing and shipping; packing the rolled furniture article in a container for shipping; allowing the rolled furniture article to decompress and rebound to a rebounded volume; and joining the furniture article in the rebounded volume to a second furniture article in a second rebounded volume to form a linked furniture system.

Embodiment 14. The method of Embodiment 13, wherein the linked furniture system comprises a sofa.

Embodiment 15. The method of Embodiment 13 or 14, wherein the linked furniture system comprises a sectional sofa.

Embodiment 16. The method of any one of Embodiments 13 through 15, further comprising joining a third furniture article in a third rebounded volume to the linked furniture system.

Embodiment 17. The method of any one of Embodiments 13 through 16, wherein joining the furniture article in the rebounded volume to a second furniture article comprises zipping a portion of a decorative cover of the furniture article to a portion of a decorative cover of the second furniture article.

Embodiment 18. The method of any one of Embodiments 13 through 17, wherein forming a furniture article from a unitary block of high-density rebound foam comprises: cutting the unitary block of high-density rebound foam to a furniture shape; and encasing the furniture shape with a decorative outer cover.

Embodiment 19. The method of Embodiment 18, wherein the furniture shape comprises a chair.

Embodiment 20. The method of any one of Embodiments 13 through 19, wherein the compressed and pressurized furniture article is substantially planar.

Embodiment 21. A method of forming a furniture article, the method comprising: forming a first furniture element from a unitary block of high-density rebound foam; compressing the first furniture element with a hydraulic press from an initial volume to a compressed volume, the compressed volume being substantially planar; reducing a pressure, simultaneous to compressing, of the first furniture element to form a first compressed furniture element; rolling the first compressed furniture element in a wrapping to form a first rolled furniture element for packing and shipping; allowing the rolled first furniture element to decompress and rebound to a first rebounded volume; forming a second furniture element from a unitary block of high-density rebound foam; compressing the second furniture element with a hydraulic press from an initial volume to a compressed volume, the compressed volume being substantially planar; reducing a pressure, simultaneous to compressing, of the second furniture element to form a second compressed furniture element; rolling the second compressed furniture element in a wrapping to form a second rolled furniture element for packing and shipping; allowing the second rolled furniture element to decompress and rebound to a second rebounded volume; and joining the first furniture element in the first rebounded volume to the second furniture element in the second rebounded volume to form the furniture article.

Embodiment 22. The method of Embodiment 21, wherein the furniture article comprises a sofa.

Embodiment 23. The method of Embodiment 21 or 22, wherein the furniture article comprises a sectional couch.

Embodiment 24. The method of any one of Embodiments 21 through 23, further comprising: forming a third furniture element from a unitary block of high-density rebound foam; compressing the third furniture element with a hydraulic press from an initial volume to a compressed volume, the compressed volume being substantially planar; reducing a pressure, simultaneous to compressing, of the third furniture element to form a third compressed furniture element; rolling the third compressed furniture element in a wrapping to form a third rolled furniture element for packing and shipping; allowing the third rolled furniture element to decompress and rebound to a third rebounded volume; and associating the third furniture element in the third rebounded volume with the furniture article.

Embodiment 25. The method of Embodiment 24, wherein the third furniture element comprises an ottoman and the furniture article comprises a couch.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It should also be noted that some of the embodiments disclosed herein may have been disclosed in relation to a particular furniture article (e.g., a couch); however, other articles (e.g., chairs, ottomans, sectionals, cushions, tables, coffee tables, desks, lounge chairs, beds, etc.) are also contemplated.

In one embodiment, the terms "about" and "approximately" refer to numerical parameters within 10% of the indicated range. The terms "a," "an," "the," and similar referents used in the context of describing the embodiments of the present disclosure (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the embodiments of the present disclosure and does not pose a limitation on the scope of the present disclosure. No language in the specification should be construed as indicating any non-claimed element essential to the practice of the embodiments of the present disclosure.

Groupings of alternative elements or embodiments disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Certain embodiments are described herein, including the best mode known to the author(s) of this disclosure for carrying out the embodiments disclosed herein. Of course, variations on these described embodiments will become apparent to those of ordinary skill in the art upon reading the foregoing description. The author(s) expects skilled artisans to employ such variations as appropriate, and the author(s)

intends for the embodiments of the present disclosure to be practiced otherwise than specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

Specific embodiments disclosed herein may be further limited in the claims using consisting of or consisting essentially of language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of this disclosure so claimed are inherently or expressly described and enabled herein.

Although this disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A method comprising:

encasing a unitary block of high-density rebound foam with a decorative outer cover, the decorative outer cover including at least one connection mechanism hidden into the decorative outer cover;

compressing the unitary block of high-density rebound foam with a hydraulic press from an initial volume to a compressed volume, the unitary block of high-density rebound foam forming a furniture article, the furniture article being planar in the compressed volume and the compressed volume being about one-fourth to about one-seventh of the initial volume;

reducing a pressure, simultaneous to the compressing, of the unitary block of high-density rebound foam to form a compressed furniture article;

rolling the compressed furniture article in a wrapping to form a rolled furniture article for packing and shipping;

packing the rolled furniture article in a container for shipping;

allowing the rolled furniture article to decompress and return to the initial volume; and joining the furniture article in the initial volume to a second furniture article in a second initial volume to form a linked furniture element by connecting the at least one connection mechanism of the decorative outer cover with a corresponding connection mechanism of a second decorative outer cover of the second furniture article.

2. The method of claim 1, wherein reducing the pressure, simultaneous to the compressing, of the unitary block of high-density rebound foam to form the compressed furniture article comprises:

applying negative pressure to the unitary block of high-density rebound foam; and vacuum-packing the unitary block of high-density rebound foam.

3. The method of claim 1, wherein rolling the compressed furniture article in the wrapping to form the rolled furniture article for packing and shipping comprises:

rolling the compressed furniture article in plastic wrap; and binding the rolled furniture article with multiple strips of tape.

4. The method of claim 1, wherein packing the rolled furniture article in the container for shipping comprises packing the rolled furniture article in a box.

5. The method of claim 1, wherein the unitary block of high-density rebound foam forms a chair.

6. The method of claim 1, wherein the unitary block of high-density rebound foam forms an ottoman.

7. The method of claim 1, wherein joining the furniture article in the initial volume to the second furniture article comprises zipping the furniture article to the second furniture article.

8. The method of claim 1, further comprising covering the second furniture article with the second decorative outer cover.

9. The method of claim 8, wherein joining the furniture article in the initial volume to the second furniture article comprises connecting a zipper of the decorative outer cover with a zipper of the second decorative outer cover of the second furniture article.

10. A method comprising:

encasing a unitary block of high-density rebound foam with a decorative outer cover, the decorative outer cover including at least one connection mechanism hidden into the decorative outer cover;

forming a furniture article from the unitary block of high-density rebound foam;

compressing the furniture article with a hydraulic press from an initial volume to a compressed volume, the compressed volume being planar;

reducing a pressure, simultaneous to the compressing, of the furniture article to form a compressed furniture article;

rolling the compressed furniture article in a wrapping to form a rolled furniture article for packing and shipping;

packing the rolled furniture article in a container for shipping;

allowing the rolled furniture article to decompress and rebound to a rebounded volume; and joining the furniture article in the rebounded volume to a second furniture article in a second rebounded volume to form a linked furniture system by connecting the at least one connection mechanism hidden into the decorative outer cover with a corresponding hidden connection mechanism of the second furniture article.

11. The method of claim 10, wherein the linked furniture system comprises a sofa.

12. The method of claim 10, wherein the linked furniture system comprises a sectional sofa.

13. The method of claim 10, further comprising joining a third furniture article in a third rebounded volume to the linked furniture system.

14. The method of claim 10, wherein joining the furniture article in the rebounded volume to the second furniture article comprises zipping a portion of the decorative outer cover to a portion of a second decorative outer cover of the second furniture article.

15. The method of claim 10, wherein forming the furniture article from the unitary block of high-density rebound foam comprises:

cutting the unitary block of high-density rebound foam to a furniture shape.

16. The method of claim 15, wherein the furniture shape comprises a chair.

17. The method of claim 10, wherein the compressed furniture article is planar.

18. A method of forming a couch, the method comprising:

forming a first couch element from a unitary block of high-density rebound foam, the first couch element having a seat portion and a back portion;

encasing the first couch element with a decorative outer cover, the decorative outer cover including at least one connection mechanism hidden into the decorative outer cover;

compressing the first couch element with a hydraulic press from an initial volume to a compressed volume, the compressed volume being planar;

reducing a pressure, simultaneous to the compressing, of the first couch element to form a first compressed couch element;

rolling the first compressed couch element in a wrapping to form a first rolled couch element for packing and shipping;

allowing the rolled first rolled couch element to decompress and rebound to a first rebounded volume;

forming a second couch element from a unitary block of high-density rebound foam, the second couch element having a seat portion and a back portion;

compressing the second couch element with a hydraulic press from an initial volume to a compressed volume, the compressed volume being planar;

reducing a pressure, simultaneous to the compressing, of the second couch element to form a second compressed couch element;

rolling the second compressed couch element in a wrapping to form a second rolled couch element for packing and shipping;

allowing the second rolled couch element to decompress and rebound to a second rebounded volume; and joining the first couch element in the first rebounded volume to the second couch element in the second rebounded volume by connecting the at least one hidden connection mechanism of the decorative outer cover of the first couch element with a corresponding hidden connection mechanism of a second decorative outer cover of the second couch element, thereby forming the couch.

19. The method of claim 18, further comprising:

forming a third couch element from a unitary block of high-density rebound foam;

compressing the third couch element with a hydraulic press from an initial volume to a compressed volume, the compressed volume being planar;

reducing a pressure, simultaneous to the compressing, of the third couch element to form a third compressed couch element;

rolling the third compressed couch element in a wrapping to form a third rolled couch element for packing and shipping;

allowing the third rolled couch element to decompress and rebound to a third rebounded volume; and associating the third couch element in the third rebounded volume with the couch.

* * * * *